US011096859B2

(12) United States Patent
Soga

(10) Patent No.: US 11,096,859 B2
(45) Date of Patent: Aug. 24, 2021

(54) MASSAGE UNIT AND MASSAGE MACHINE

(71) Applicant: FUJI MEDICAL INSTRUMENTS MFG. CO., LTD., Osaka (JP)

(72) Inventor: Takuji Soga, Osaka (JP)

(73) Assignee: FUJI MEDICAL INSTRUMENTS MFG. CO., LTD., Osaka (JP)

( * ) Notice: Subject to any disclaimer, the term of this patent is extended or adjusted under 35 U.S.C. 154(b) by 278 days.

(21) Appl. No.: 16/032,956

(22) Filed: Jul. 11, 2018

(65) Prior Publication Data

US 2019/0125622 A1 May 2, 2019

(30) Foreign Application Priority Data

Oct. 27, 2017 (JP) ..... JP2017-208235

(51) Int. Cl.
*A61H 15/00* (2006.01)
*A61H 7/00* (2006.01)

(52) U.S. Cl.
CPC ..... *A61H 15/0078* (2013.01); *A61H 7/007* (2013.01); *A61H 2015/0014* (2013.01);
(Continued)

(58) Field of Classification Search
CPC ..... A61H 15/0078; A61H 7/007; A61H 2201/1623; A61H 2205/081; A61H 2203/0431; A61H 2201/0103; A61H 2015/0042; A61H 2201/1669; A61H 2201/0149; A61H 2015/0014; A61H 2201/1654; A61H 2007/009; A61H 2015/0007; A61H 23/006; A61H 2201/12;
(Continued)

(56) References Cited

U.S. PATENT DOCUMENTS

2005/0192520 A1* 9/2005 Morita ..... A61H 7/007 601/99
2007/0167887 A1* 7/2007 Tsukada ..... A61H 7/007 601/97

(Continued)

FOREIGN PATENT DOCUMENTS

JP 2002-159549 A 6/2002
JP 2008-49177 A 3/2006
JP 2006-149855 A 6/2006

OTHER PUBLICATIONS

JP, Japanese Office Action dated Jun. 29, 2021 in Japanese Application No. 2017-208235, 11 pages with translation.

*Primary Examiner* — Victoria Murphy
*Assistant Examiner* — Arielle Wolff
(74) *Attorney, Agent, or Firm* — Masuvalley & Partners

(57) ABSTRACT

A massage unit includes a base member, a treatment element driven unit, and a slide mechanism. A lower portion of the treatment element drive unit is fitted to the base member to be rotatable about a first rotation axis. One end of the slide mechanism is fitted to a lower portion of the base member. The other end of the slide mechanism is fitted to the treatment element drive unit. At least one of the following structures is adopted: a structure where the one end of the slide mechanism is fitted to a lower portion of the base member to be rotatable about a second rotation axis; and a structure where the other end of the slide mechanism is fitted to the treatment element drive unit to be rotatable about a third rotation axis.

7 Claims, 11 Drawing Sheets

(52) U.S. Cl.
CPC ..... *A61H 2015/0042* (2013.01); *A61H 2201/0103* (2013.01); *A61H 2201/0149* (2013.01); *A61H 2201/1623* (2013.01); *A61H 2201/1654* (2013.01); *A61H 2201/1669* (2013.01); *A61H 2203/0431* (2013.01); *A61H 2205/081* (2013.01)

(58) Field of Classification Search
CPC .... A61H 2201/1207; A61H 2201/1215; A61H 2201/1436; A61H 2201/1671; A61H 2201/1676; A61H 2201/5051; A61H 2201/5056; A61H 2201/5053; A61H 2201/1664
See application file for complete search history.

(56) References Cited

U.S. PATENT DOCUMENTS

2007/0299377 A1 12/2007 Shiraishi
2012/0265112 A1* 10/2012 Chen ..... A61H 15/0078 601/115

* cited by examiner

MASSAGE UNIT AND MASSAGE MACHINE

This nonprovisional application claims priority under 35 U.S.C. § 119(a) on Patent Application No. 2017-208235 filed in Japan on Oct. 27, 2017, the entire contents of which are hereby incorporated by reference.

BACKGROUND OF THE INVENTION

Field of the Invention

The present invention relates to a massage unit having a treatment element, and a massage machine equipped with the massage unit.

Description of the Related Art

Japanese Patent Application Publication No. 2002-159549 discloses a massage machine capable of significantly changing the projection amount of massage balls.

In a massage machine according to a first embodiment disclosed in FIG. 1 to FIG. 6 of Japanese Patent Application Publication No. 2002-159549, along with rotation of a forward-backward axis extending along a front-back direction, a driven threaded body, which is fitted to a massage-ball drive unit casing, moves along the forward-backward axis. By the driven threaded body, the massage-ball drive unit casing moves in the front-back direction to advance or retract, causing massage balls to move in the front-back direction to advance or retract.

In a massage machine according to a second embodiment of Japanese Patent Application Publication No. 2002-159549 disclosed in FIG. 7 to FIG. 12, a pair of left and right pinion gears are fitted to a forward-backward axis extending along a left-right width direction, and a pair of left and right racks each in an arc shape are fitted to an upper portion of the massage-ball drive unit casing. Along with rotation of the forward-backward axis, the pinion gears, while rotating, slide along the racks. The sliding of the pinion gears along the racks causes the massage-ball drive unit casing to swing forward and backward about an up-and-down axis, causing massage balls to move in the front-back direction to advance or retract.

If the massage machine according to the first embodiment disclosed in FIG. 1 to FIG. 6 of Japanese Patent Application Publication No. 2002-159549 were configured to be capable of significantly changing the projection amount of the massage balls, the forward-backward axis would project forward more from the massage-ball drive unit casing as a result of retraction of the massage-ball drive unit casing. Accordingly, if the massage balls are not appropriately arranged, a front end of the forward-backward axis might be disadvantageously located anterior to the massage balls when the massage balls move backward in a beating operation.

In the massage machine according to the second embodiment of Japanese Patent Application Publication No. 2002-159549 disclosed in FIG. 7 to FIG. 12, the massage-ball drive unit casing has the arc-shaped racks fitted to an upper portion thereof, with the pinion gears arranged above the arc-shaped racks. That is to say, the massage machine of the second embodiment of Japanese Patent Application Publication No. 2002-159549 disclosed in FIG. 7 to FIG. 12 has a configuration that requires some space above the massage-ball drive unit casing, and this configuration is not suitable, for example, in a case where it is desirable for the uppermost reachable position of the massage balls to be as high as possible.

SUMMARY OF THE INVENTION

An object of the present invention is to provide a massage unit that has a configuration in which neither of the following is necessary: a forward-backward axis extending in a front-back direction and screwed into a driven threaded body; and a rack which is arc-shaped and a fitting position thereof is in an upper portion of a treatment element drive unit, the massage unit being capable of significantly changing a projection amount of a treatment element, and to provide a massage machine equipped with such a massage unit.

According to an aspect of the present invention, a massage unit includes a base member, a treatment element drive unit which has a treatment element and a drive portion which drives the treatment element, and a slide mechanism which is extensible and contractible in a slide axis direction which is along a surface substantially perpendicular to a left-right direction. Here, a lower portion of the treatment element drive unit is fitted to the base member to be rotatable about a first rotation axis extending along the left-right direction, one end of the slide mechanism is fitted to a lower portion of the base member, an other end of the slide mechanism is fitted to the treatment element drive unit, and for fitting of the one end and the other end of the slide mechanism, at least one of the following structures is adopted: a structure where the one end of the slide mechanism is fitted to the lower portion of the base member to be rotatable about a second rotation axis extending along the left-right direction; and a structure where the other end of the slide mechanism is fitted to the treatment element drive unit to be rotatable about a third rotation axis extending along the left-right direction.

According to another aspect of the present invention, a massage machine includes the above-described massage unit, a body support portion which supports a body of a treated person, and a guide rail which extends along a surface of the body support portion, the surface being in contact with the body. Here, the massage unit is guided by the guide rail to move up and down in the body support portion.

The significance and effects of the present invention will be further clarified by the descriptions of embodiments below. Here, it should be understood that the following embodiments are merely an example of how the present invention can be implemented, and thus the significance of the present invention and the significance of terms describing constituent elements thereof are not limited in any way by those described in the following embodiments.

DESCRIPTION OF THE PREFERRED EMBODIMENTS

Hereinafter, exemplary embodiments of the present disclosure will be described in detail with reference to the appended drawings.

1. Configuration of Massage Machine

Figure 1:
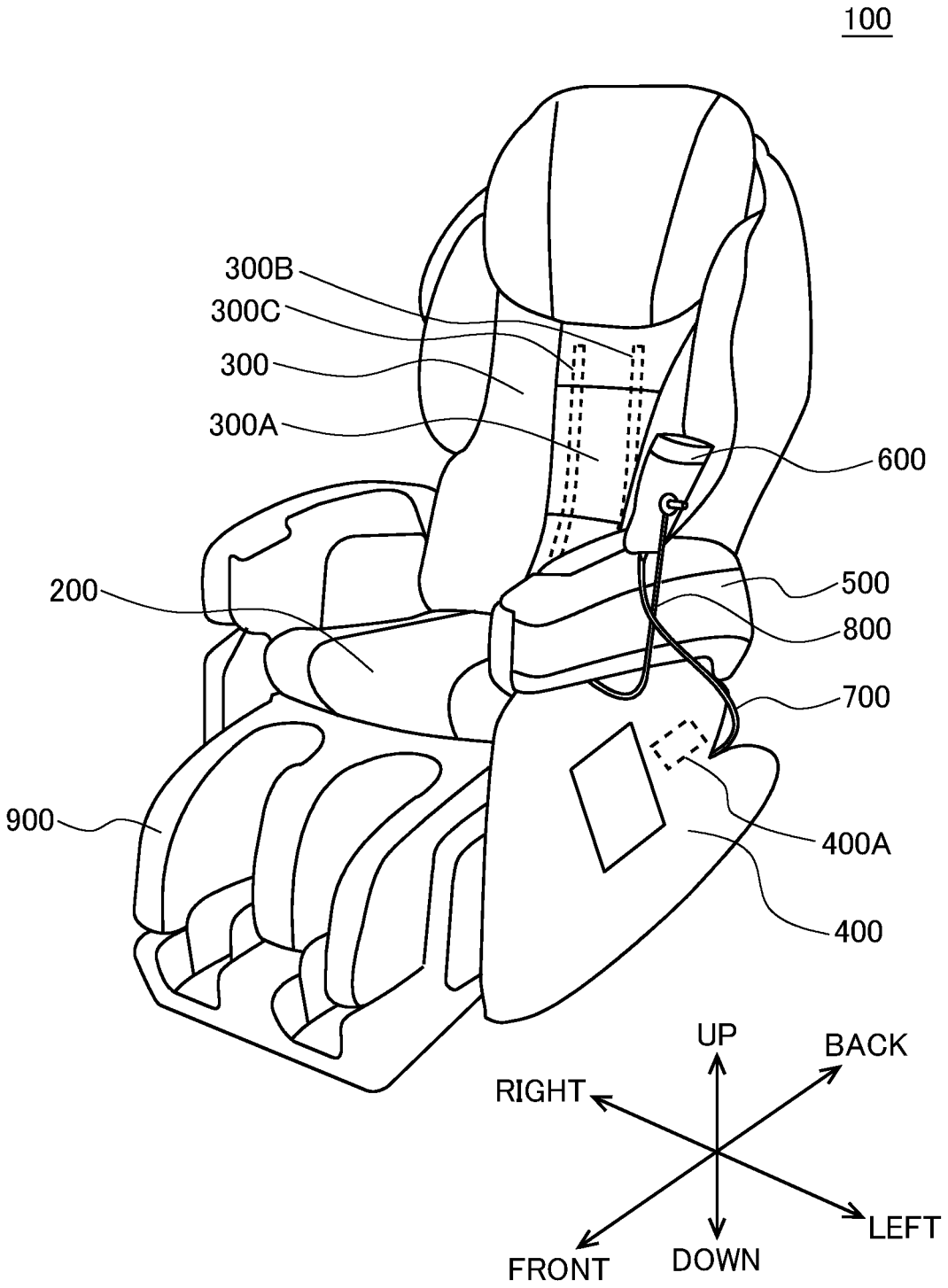
FIG. 1 is a perspective view of a massage machine according to an embodiment.

FIG. 1 is a perspective view of a massage machine 100 according to an embodiment. In the following descriptions, "a front side" refers to a front side (a front face side) as viewed from a treated person sitting in the massage machine 100, and "a back side" refers to a back side (a back face side) as viewed from the treated person sifting in the massage machine 100. "An upper side" refers to an upper side (a head side) as viewed from the treated person sifting in the massage machine 100, and "a lower side" refers to a lower side (a leg side) as viewed from the treated person sitting in the massage machine 100. "A right side" refers to a right side as viewed from the treated person sifting in the massage machine 100, and "a left side" refers to a left side as viewed from the treated person sitting in the massage machine 100.

The massage machine 100 includes a seat portion 200, a backrest portion 300, base portions 400, arm treatment portions 500, an operation portion 600, a cord wire 700, a stand 800, and a legrest portion 900.

The seat portion 200 supports buttocks and the thighs of a treated person.

The backrest portion 300 supports the shoulders, the hips, and the back of the treated person. The backrest portion 300 is fitted to a back end of the seat portion 200 to be rotatable about a reclining rotation axis extending along a left-right direction. The backrest portion 300 has built therein guide rails 300B and 300C both extending along a surface 300A which is in contact with the shoulders and the hips of the treated person. A massage unit 1, which will be described later, is guided by the guide rails 300B and 300C to move up and down inside the backrest portion 300. Here, the guide rails 300B and 300C may be extended to a back portion of the seat portion 200 to allow the massage unit 1, which will be described later, to move up and down inside both the seat portion 200 and the backrest portion 300.

The base portions 400 are provided to stand below the seat portion 200, on both the left and right sides of the seat portion 200. The base portion 400 provided on the left side of the seat portion 200 has a control portion 400A built therein.

The arm treatment portions 500 are provided to stand above the seat portion 200, on both the left and right sides of the seat portion 200. The arm treatment portions 500 each have an inflatable-deflatable bag built therein, and each perform treatment while supporting an arm of the treated person by means of the inflatable-deflatable bag.

The operation portion 600 is an input device via which the treated person makes a selection from among treatment patterns or adjusts treatment strength. The operation portion 600 is connected to the control portion 400A via the cord wire 700. The control portion 400A controls each portion of the massage machine 100 based on signals received from the operation portion 600.

The stand 800 is secured to the arm treatment portion 500 provided on the left side of the seat portion 200. The operation portion 600 is attachable-detachable with respect to the stand 800.

The legrest portion 900 supports the legs of the treated person.

2. Configuration of Massage Unite

Figure 2A:
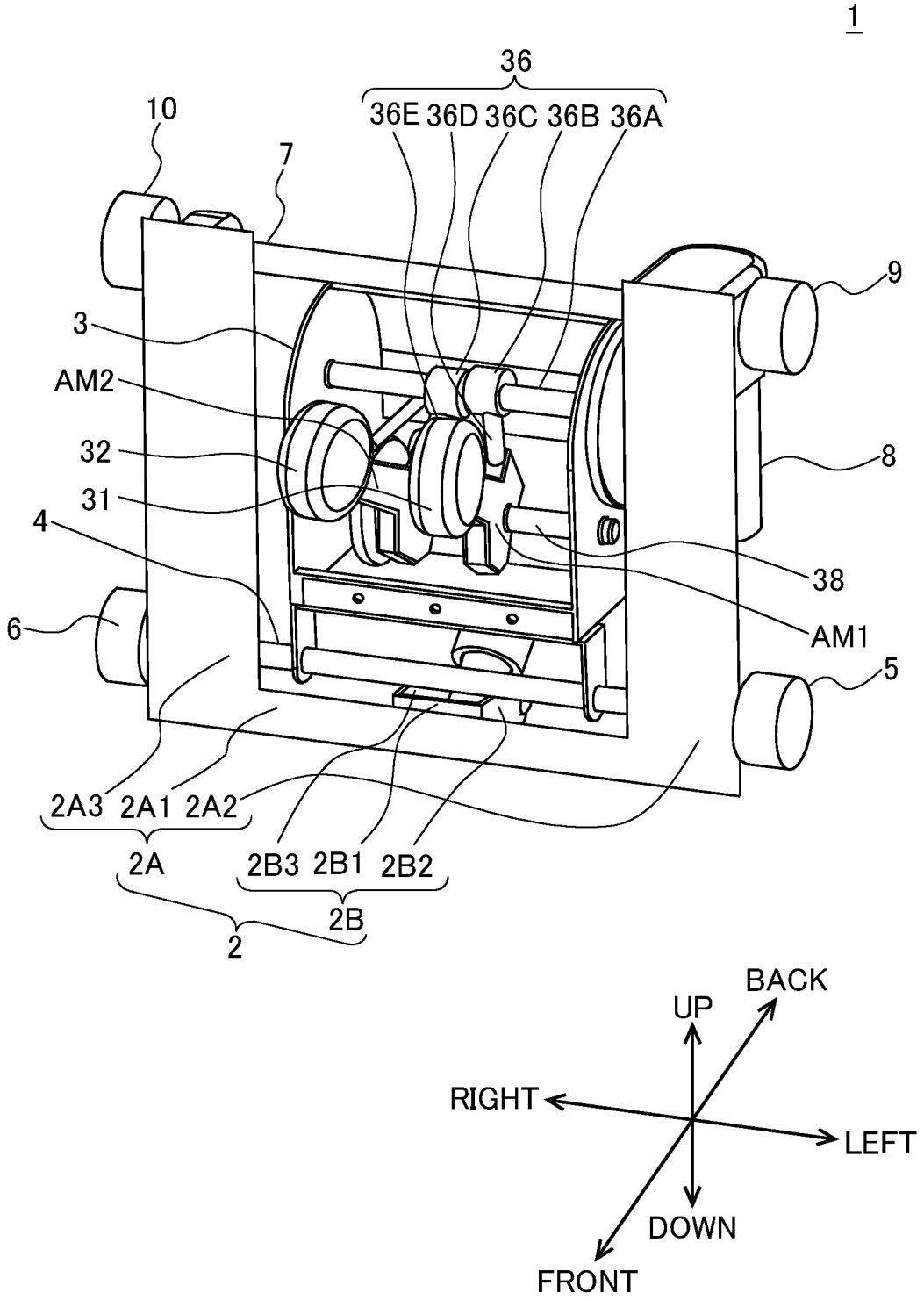
FIG. 2A is a front perspective view of a massage unit according to an embodiment.
Figure 2B:
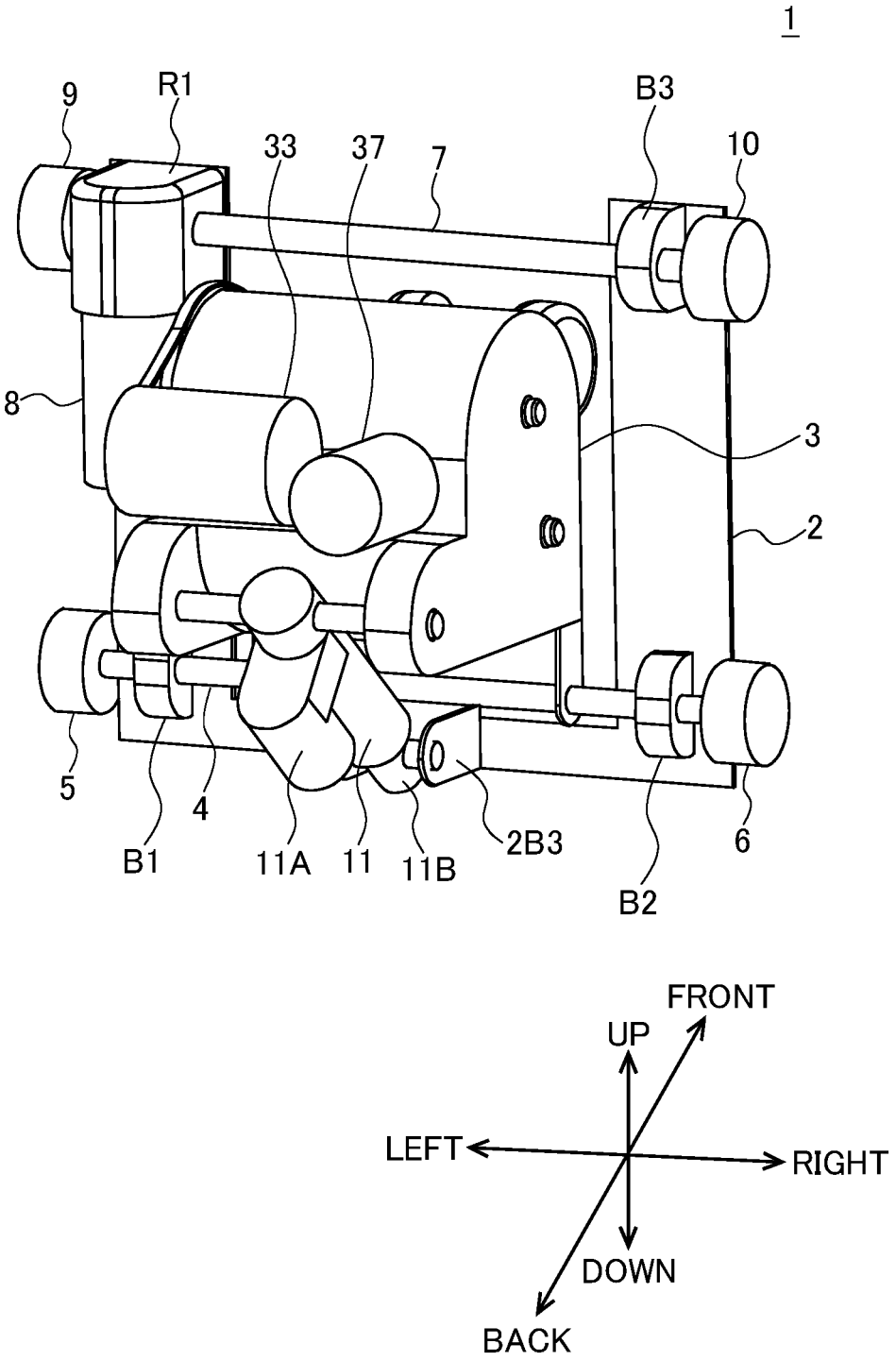
FIG. 2B is a back perspective view of a massage unit according to an embodiment.
Figure 3:
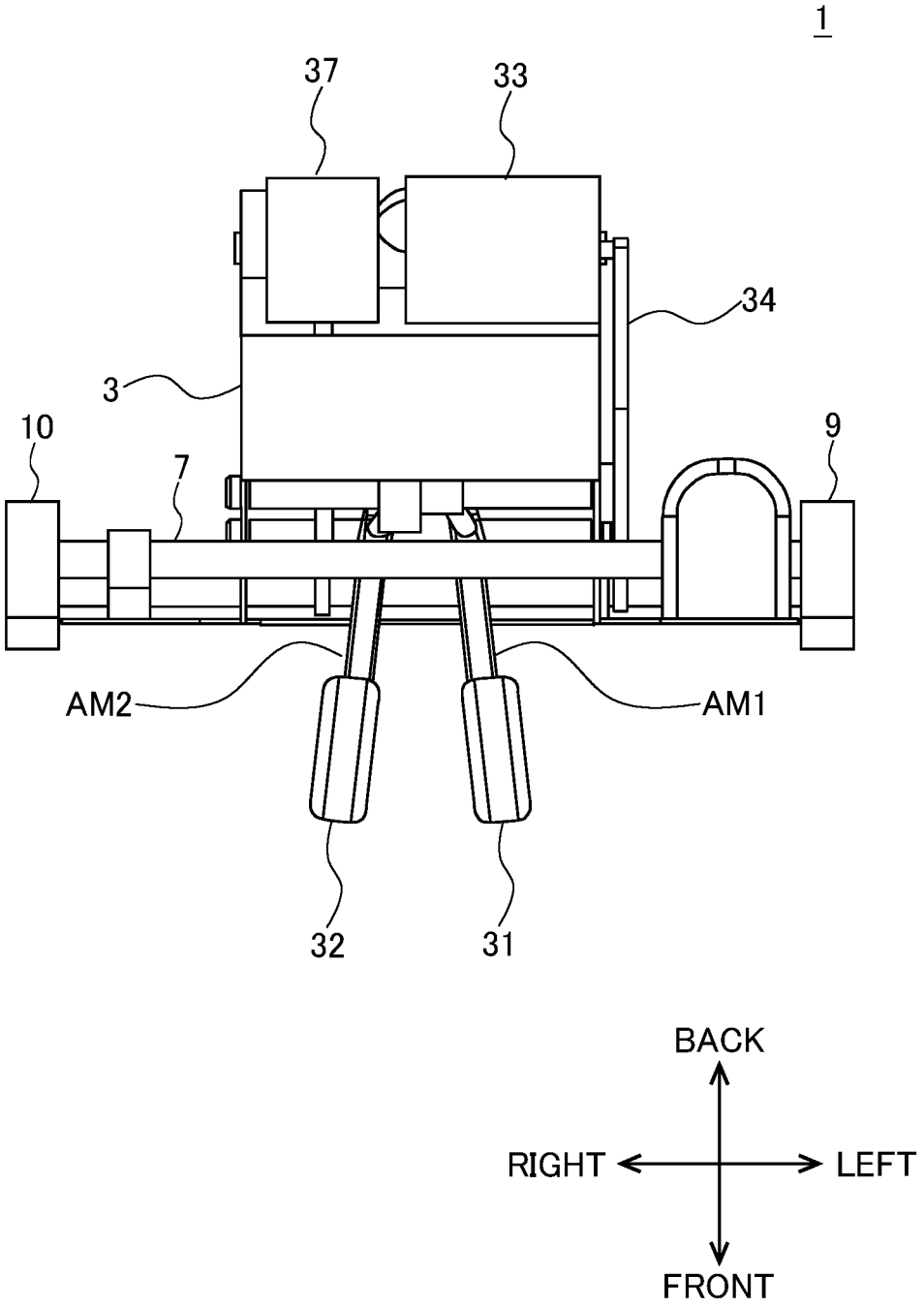
FIG. 3 is a top view of a massage unit according to an embodiment.
Figure 4:
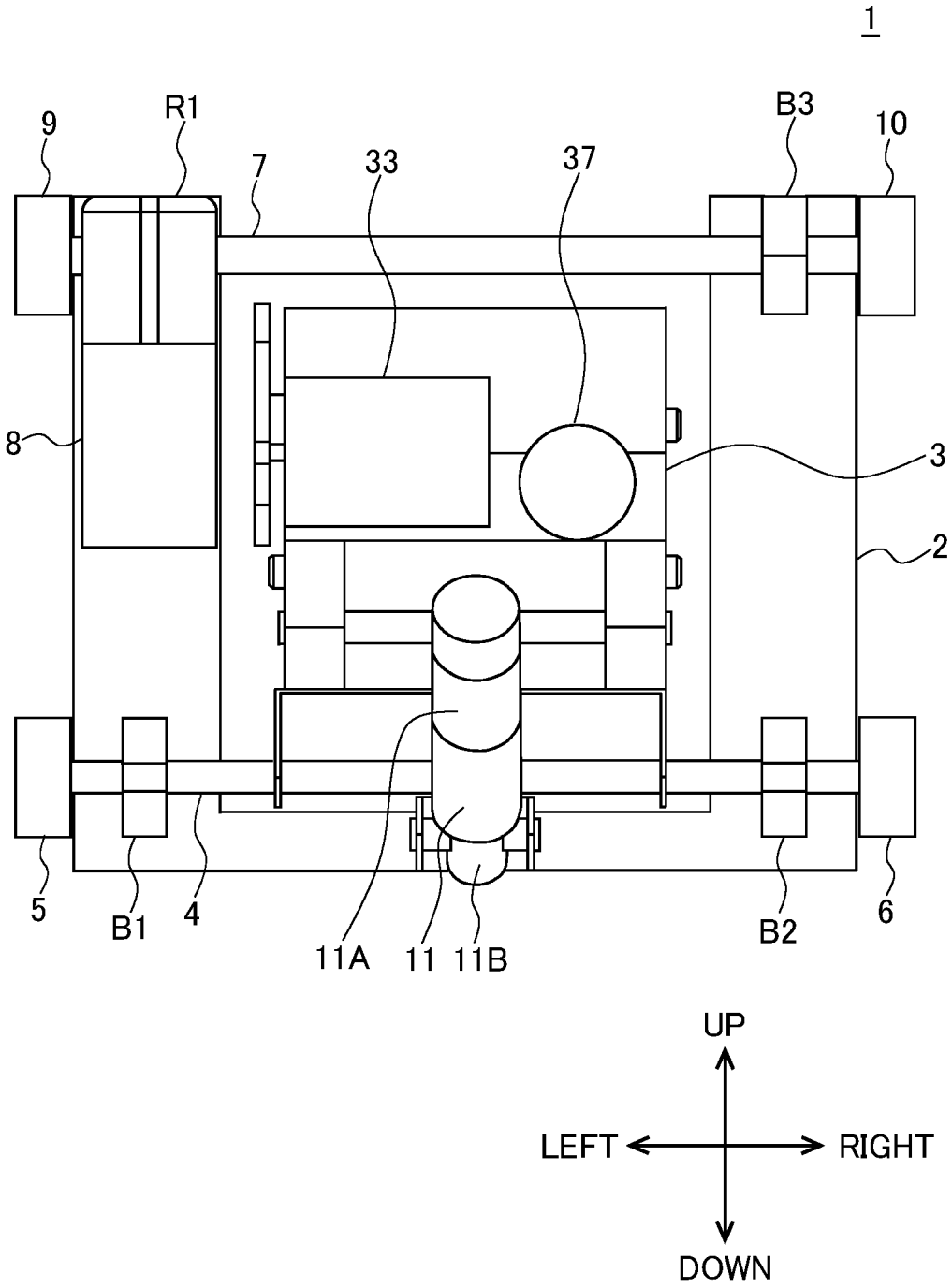
FIG. 4 is a back view of a massage unit according to an embodiment.
Figure 5:
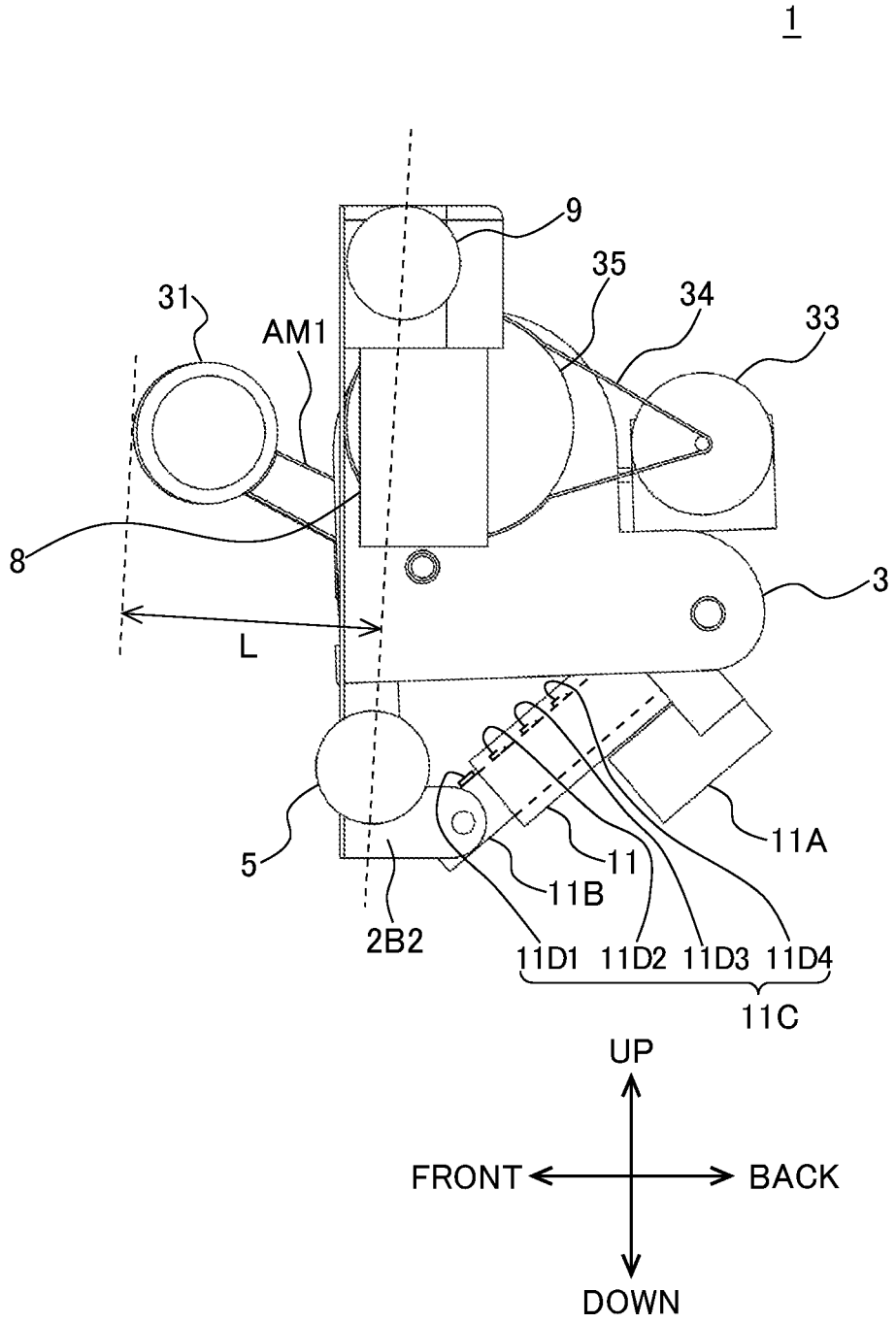
FIG. 5 is a left side view of a massage unit according to an embodiment.
Figure 6:
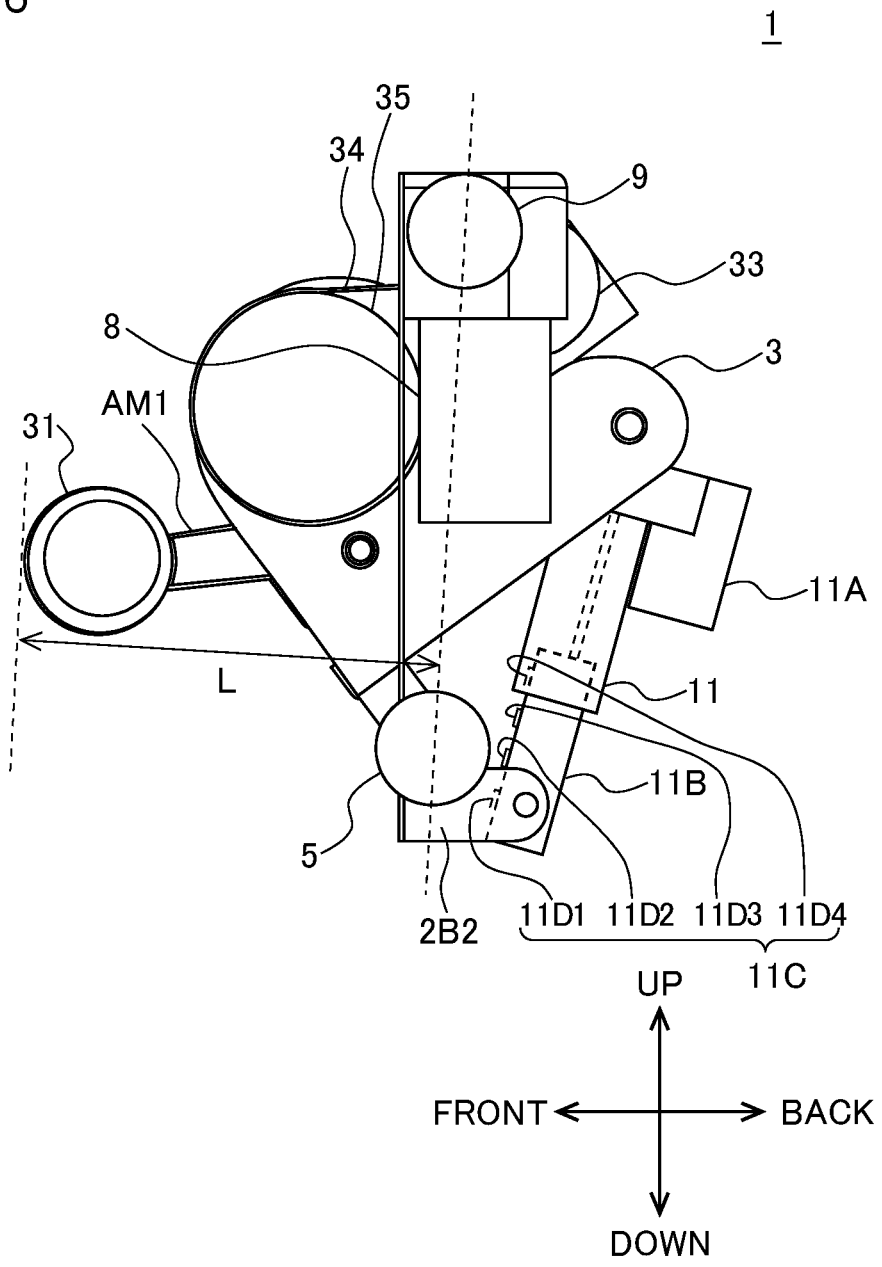
FIG. 6 is a perspective view of a massage unit according to an embodiment, with a slide mechanism in an extended state.

FIG. 2A is a front perspective view of the massage unit 1. FIG. 2B is a back perspective view of the massage unit 1. FIG. 3 is a top view of the massage unit 1. FIG. 4 is a back view of the massage unit 1. FIG. 5 is a left side view of the massage unit 1. FIG. 6 is a perspective view of the massage unit 1, with a slide mechanism 11 in an extended state.

The massage unit 1 includes a base member 2. The base member 2 includes a flat plate member 2A and a U-shaped member 2B.

The flat plate member 2A includes a first extension portion 2A1 which extends in the left-right direction, a second extension portion 2A2 which extends upward from a left end of the first extension portion 2A1, and a third extension portion 2A3 which extends upward from a right end of the first extension portion 2A1.

The U-shaped member 2B includes a base portion 2B1, a left wall portion 2B2 extending backward from a left end of the base portion 2B1, and a right wall portion 2B3 extending backward from a right end of the base portion 2B1. A front surface of the base portion 2B1 is secured to a center of a back surface of the first extension portion 2A1.

The massage unit 1 further includes a treatment element drive unit 3, a shaft 4, and guide rollers 5 and 6. A lower portion of the treatment element drive unit 3 is fitted to the base member 2 to be rotatable about a first rotation axis, which is a center axis of the shaft 4, extending along the left-right direction. The shaft 4 is rotatably supported by a pair of bearing portions B1 and B2. A left end of the shaft 4 is provided with the guide roller 5, and a right end of the shaft 4 is provided with the guide roller 6. The guide roller 5 slides on the guide rail 300B to move the massage unit 1 up and down, while the guide roller 6 slides on the guide rail 300C to move the massage unit 1 up and down. A description will be given later of the details of the treatment element drive unit 3.

The massage unit 1 further includes an up-and-down axis 7, an up-and-down motor 8, and pinion gears 9 and 10. With the up-and-down axis 7 extending along the left-right direction, the up-and-down motor 8 is interlocked. Via a rotation transmission member R1, the up-and-down motor 8 is interlocked with the up-and-down axis 7. The rotation transmission member R1 includes a bearing portion and a gear mechanism for changing a rotation axis direction. The up-and-down axis 7 is rotatably supported by a bearing portion B3 and a bearing portion inside the rotation transmission member R1. The up-and-down motor 8, which is a drive source for moving the massage unit 1 up and down, is secured to an upper portion of a back surface of the second extension portion 2A2. At a left end of the up-and-down axis 7, a pinion gear 9 is provided, and at a right end of the up-and-down axis 7, a pinion gear 10 is provided. The pinion gear 9 meshes with a rack provided on the guide rail 300B, and the pinion gear 10 meshes with a rack provided on the guide rail 300C. Accordingly, when the up-and-down motor 8 is driven to rotate the up-and-down axis 7, the massage unit 1 is moved up and down along the guide rails 300B and 300C. The up-and-down axis 7 is disposed at a position that is behind and above the shaft 4.

The massage unit 1 further includes a slide mechanism 11. The slide mechanism 11 includes a slide motor 11A, which is a drive source for the slide mechanism 11. The slide mechanism 11 is driven to extend or contract in a slide axis direction by the slide motor 11A.

The slide axis direction (a longitudinal direction) of the slide mechanism 11 is a direction along a surface that is substantially perpendicular to the left-right direction. As illustrated in FIG. 5 and FIG. 6, the slide axis direction (the longitudinal direction) of the slide mechanism 11 varies in accordance with an extension-contraction amount of the slide mechanism 11.

One end of the slide mechanism 11 is fitted to a lower portion of the base member 2, more specifically, to the left and right wall portions 2B2 and 2B3 of the base member 2, to be rotatable about a second rotation axis, extending in the left-right direction.

The other end of the slide mechanism 11 is fitted to the treatment element drive unit 3 to be rotatable about a third rotation axis, extending in the left-right direction. The third rotation axis is disposed at a position that is behind and above the second rotation axis.

As illustrated in FIG. 6, extension of the slide mechanism 11 causes increase of a projection amount of treatment elements 31 and 32 (a distance L, on a plane perpendicular to the left-right direction, between each of lines respectively connecting rotation centers of the guide rollers 5 and 6 with rotation centers of the pinion gears 9 and 10 and such a portion of a corresponding one of the treatment elements 31 and 32 as is the farthest away from a corresponding one of the lines). That is, it is possible to significantly change the projection amount of the treatment elements 31 and 32 by extending or contracting the slide mechanism 11.

Furthermore, the massage unit 1 does not need a forward-backward axis extending along the front-back direction and screwed into a driven threaded body. Accordingly, with the massage unit 1, even if the massage balls (the treatment elements 31 and 32) are not appropriately arranged, a backward movement of the massage balls in a beating operation will not cause the front end of the forward-backward axis to move into a position anterior to the massage balls (the treatment elements 31 and 32).

Furthermore, the massage unit 1 does not need an arc-shaped rack to be fitted to an upper portion of the treatment element drive unit 3. Accordingly, in the massage unit 1, there is no need of securing a space above the treatment element drive unit 3 for disposing arc-shaped racks and pinion gears to respectively mesh with the arc-shaped racks. Thus, the massage unit 1 is preferable, for example, in a case where it is desirable for the uppermost reachable position of the treatment elements 31 and 32 to be located as high as possible.

The slide mechanism 11 further includes a sensor 11C which directly detects an extension-contraction amount of the slide mechanism 11. As the sensor 11C for directly detecting the extension-contraction amount of the slide mechanism 11, there may be used, for example, a plurality of contact sensors 11D1, 11D2, 11D3, 11D4 disposed on an outer circumferential portion of a rod member 11B at predetermined intervals in a longitudinal direction of the rod member 11B. The extension-contraction amount of the slide mechanism 11 is directly detected based on a boundary between such ones of the contact sensors 11D1, 11D2, 11D3, 11D4 as have detected contact and the others of the contact sensors 11D1, 11D2, 11D3, 11D4 which have not detected contact. It is also possible to indirectly detect the extension-contraction amount of the slide mechanism 11 based on a rotation amount of the slide motor 11A, but the indirect detection suffers significant detection errors, and thus direct detection is preferable.

The control portion 400A controls the slide motor 11A based on a result of detection performed by the sensor 11C, which directly detects the extension-contract amount of the slide mechanism 11, such that the extension-contract amount of the slide mechanism 11 reaches a set value. This makes it possible for the control portion 400A to accurately control the projection amount of the treatment elements 31 and 32.

Lastly, a description will be given of the details of the treatment element drive unit 3. The treatment element drive unit 3 includes a pair of left and right treatment elements 31 and 32, a beating mechanism which causes the treatment elements 31 and 32 to swing in the front-back direction to thereby cause the treatment elements 31 and 32 to perform a beating operation, and a kneading mechanism which causes the treatment elements 31 and 32 to rotate eccentrically to thereby cause the treatment elements 31 and 32 to perform a kneading operation.

The beating mechanism includes a beating motor 33, a transmission belt 34, a pulley 35, and a beating shaft 36. The beating shaft 36 includes an axis portion 36A which extends in the left-right direction, eccentric portions 36B and 36C which are fitted to the axis portion 36A in such a positional relationship that central axes thereof are deviated with respect to a central axis of the axis portion 36A, a projection portion 36D which projects from an outer circumferential portion of the eccentric portion 36B in a radial direction of the axis portion 36A, and a projection portion 36E which projects from an outer circumferential portion of the eccentric portion 36C in the radial direction of the axis portion 36A. When the beating motor 33 is driven, a driving force is applied to the beating shaft 36 via the transmission belt 34 and the pulley 35 to cause the beating shaft 36 to rotate. As the beating shaft 36 rotates, the projection portion 36D causes an arm AM1 to swing up and down, and the projection portion 36E causes an arm AM2 to swing up and down. The axis portion 36A may be formed integrally or separately with respect to the eccentric portions 36B and 36C.

The arm AM1 supports the treatment element 31, and the arm AM2 supports the treatment element 32. The treatment element 31 is fitted to a front end of the arm AM1, and the treatment element 32 is fitted to a front end of the arm AM2.

The kneading mechanism includes a kneading motor 37, a support axis 38, and an eccentric rotation body. The support axis 38 extends in the left-right direction via a through hole provided in a back portion of the arm AM1 and a through hole provided in a back portion of the arm AM2. The eccentric rotation body is secured to the support axis 38 at a center of the support axis 38 in the left-right direction. When the kneading motor 37 is driven, the support axis 38 rotates, and the eccentric rotation body, which is secured to the support axis 38, also rotates. The eccentric rotation body causes the arm AM1 and the arm AM2 to swing in up-down, left-right, and front-back directions.

3. Others

It should be understood that the above embodiments are examples in all respects and are not intended to limit the scope of the present invention, that the technological scope of the present invention is not indicated by the above descriptions of the embodiments but by the claims, and that all modifications within the scope of the claims and the meaning equivalent to the claims are covered.

For example, in the descriptions of the above embodiments, what is called a chair-type massage machine is dealt with, but the massage unit according to the present invention is mountable also in what is called a bed-type massage machine.

Furthermore, in the above embodiment, the other end of the slide mechanism 11 is fitted to the lower back end of the treatment element drive unit 3, but as long as each component of the treatment element drive unit 3 does not interfere with the slide mechanism 11, the other end of the slide mechanism 11 may be fitted to a position other than at the lower back end of the treatment element drive unit 3.

Furthermore, in the above embodiments, the opposite ends of the slide mechanism 11 are rotatable with respect to the components to which the slide mechanism 11 is fitted, but instead, the slide mechanism 11 may be configured such that the one end thereof is rotatable with respect to the lower portion of the base member 2 and the other end thereof is unrotatable with respect to the treatment element drive unit 3, or, conversely, the slide mechanism 11 may be configured such that the other end thereof is rotatable with respect to the treatment element drive unit 3 and the one end thereof is unrotatable with respect to the lower portion of the base member 2.

Furthermore, in the above embodiments, the guide rollers 5 and 6 are provided one at each of the opposite ends of the shaft 4, but instead, a guide shaft which extends along the left-right direction and is rotatably fitted to the base member 2 may be provided behind the shaft 4, and the guide rollers 5 and 6 may be provided on the guide shaft. According to this modified example, since the shaft 4 is positioned anterior to the up-and-down axis 7 and the guide shaft mentioned above, the first rotation axis, which is the central axis of the shaft 4, is located closer to the body of the treated person than the up-and-down axis 7 and the guide shaft are. With this configuration, it is possible to make the projection amount of the treatment elements 31 and 32 larger than in the above embodiments.

Furthermore, unlike in the above embodiment, the slide mechanism 11 may be configured not to include the slide motor 11A, and may instead be configured to include a damper for generating a resistance force against contraction. According to this modified example, the damper contracts along a contour of the treated person, and thus it is possible to set the projection amount of the treatment elements 31 and 32 in accordance with the contour of the treated person.

Furthermore, in the above embodiments, by detecting, for example, torque of the slide motor 11A, and by determining the extension-contract amount of the slide mechanism 11 based on the detected torque, it is possible to set the projection amount of the treatment elements 31 and 32 in accordance with the contour of the treated person.

Furthermore, in the above embodiments, the up-and-down axis 7 is provided in an upper portion of the base member 2, and the shaft 4 is provided in a lower portion of the base member 2; however, conversely to the above embodiments, the up-and-down axis 7 may be provided in the lower portion of the base member 2, and the shaft 4 may be provided in the upper portion of the base member 2. Here, in the case where the up-and-down axis 7 is provided in the lower portion of the base member 2, the up-and-down motor 8, which causes the up-and-down axis 7 to rotate, is also provided in the lower portion of the base member 2.

Furthermore, in the above embodiments, the treatment element drive unit 3 and the slide mechanism 11 are configured not to be movable in the left-right direction with respect to the base member 2, but the treatment element drive unit 3 and the slide mechanism 11 may be configured to be movable in the left-right direction with respect to the base member 2.

Now, a description will be given of a massage unit 1', which is an example of a massage unit having a configuration where the treatment element drive unit 3 and the slide mechanism 11 are movable in the left-right direction with respect to the base member 2.

Figure 7:
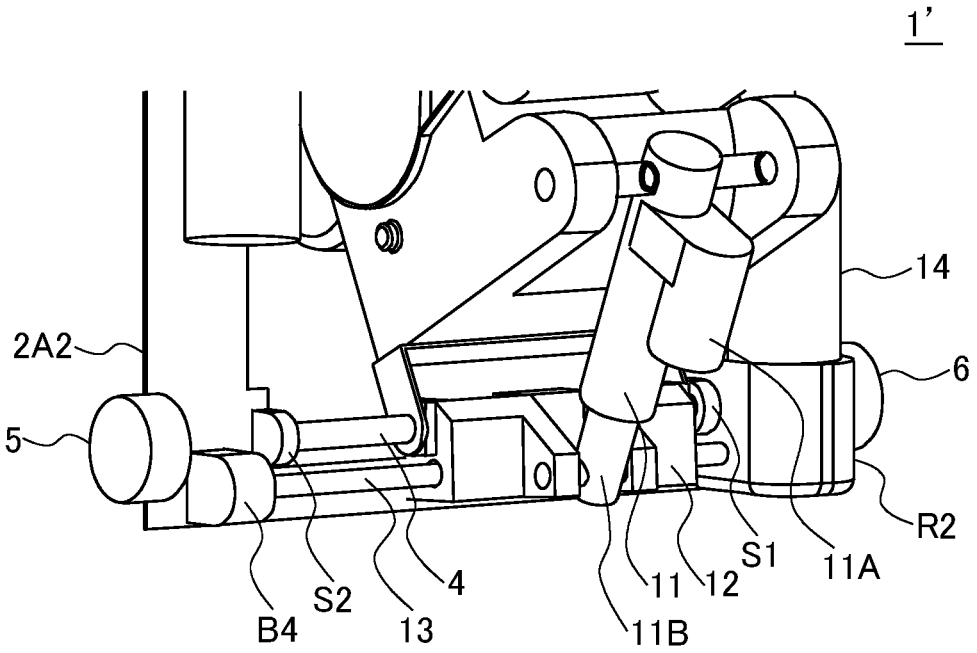
FIG. 7 is a back perspective view of part of a massage unit according to a modified example.
Figure 7:
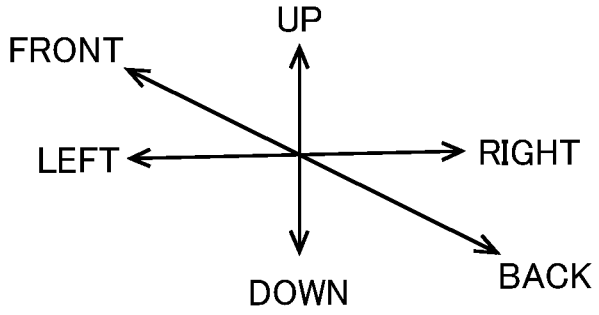
Figure 8A:
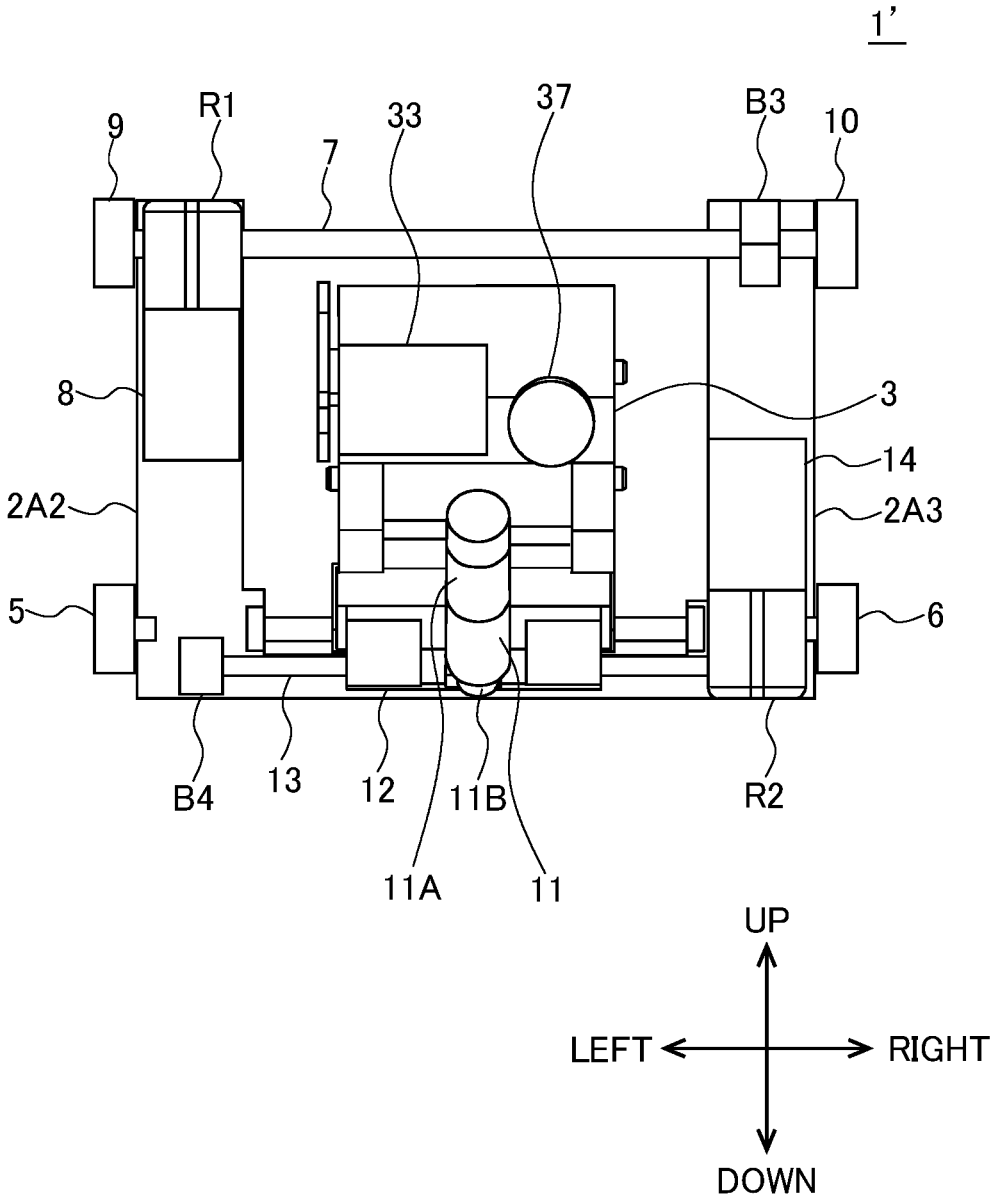
FIG. 8A is a back view of a massage unit according to a modified example.
Figure 8B:
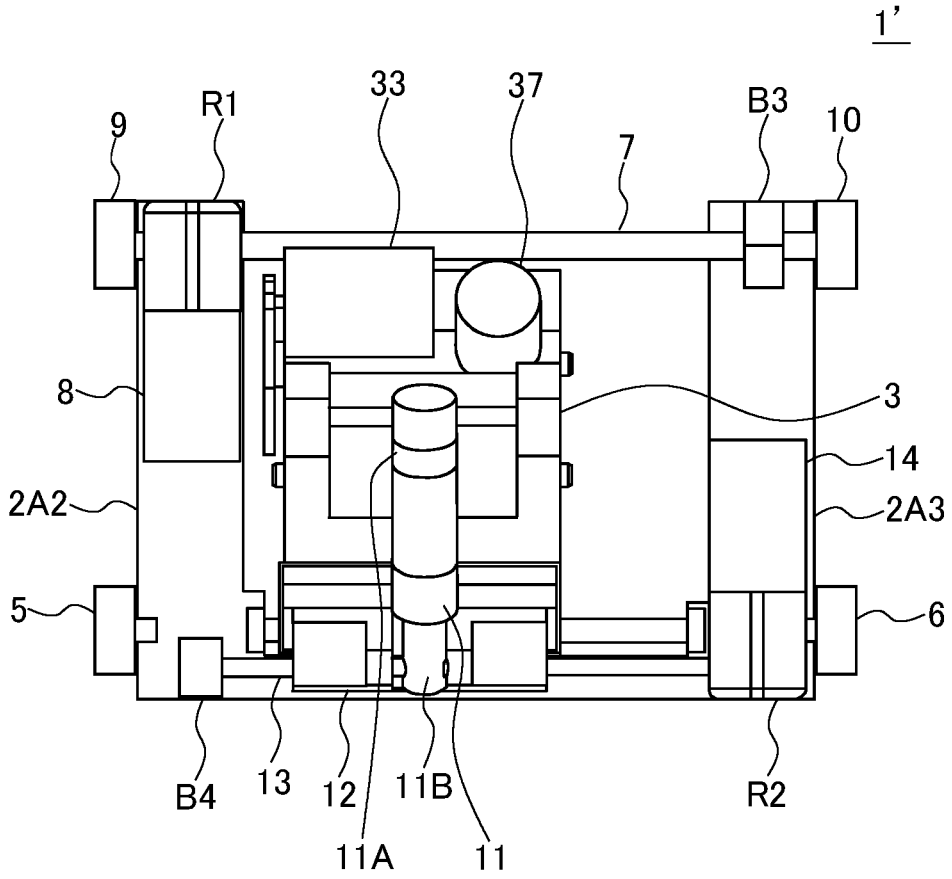
FIG. 8B is a back view of a massage unit according to a modified example.
Figure 8C:
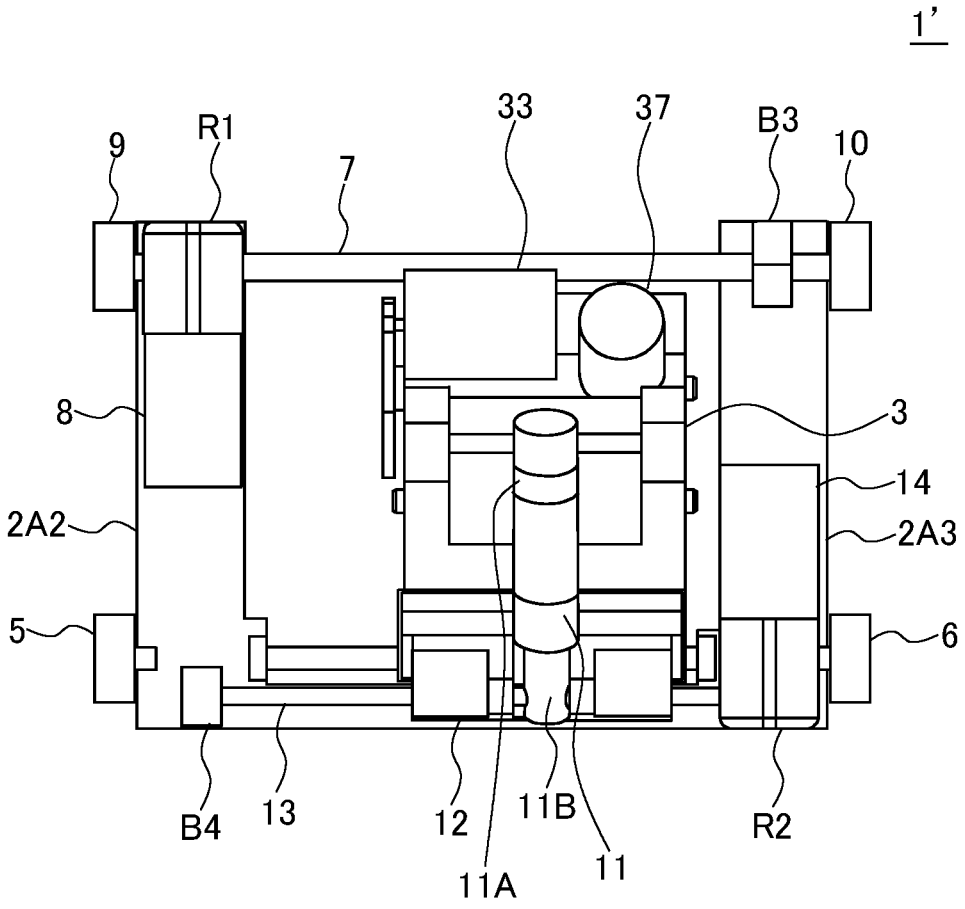
FIG. 8C is a back view of a massage unit according to a modified example.

FIG. 7 is a back perspective view of part of the massage unit 1'. FIGS. 8A to 8C are each a back view of the massage unit 1'. FIG. 8A is a back view of the massage unit 1' in a state where, with the slide mechanism 11 unextended, the treatment element drive unit 3 and the slide mechanism 11 are located at a center. FIG. 8B is a back view of the massage unit 1' in a state where, with the slide mechanism 11 extended, the treatment element drive unit 3 and the slide mechanism 11 are located to the left of the center. FIG. 8C is a back view of the massage unit 1' in a state where, with the slide mechanism 11 extended, the treatment element drive unit 3 and the slide mechanism 11 are located to the right of the center.

Hereinafter, descriptions will be given of portions of the massage unit 1' which are different from counterparts thereof in the massage unit 1, and descriptions will be omitted as to portions of the massage unit 1' that are identical with counterparts thereof in the massage unit 1.

The massage unit 1' includes, instead of the U-shaped member 2B, a nut member 12 of a ball screw mechanism. One end of the slide mechanism 11 is fitted to a lower portion of a back end of the nut member 12 to be rotatable about the second rotation axis extending in the left-right direction.

With a ball axis 13 of the ball screw mechanism, a left-right direction movement motor 14 is interlocked. The left-right direction movement motor 14 is interlocked with the ball axis 13 via a rotation transmission portion R2. The rotation transmission portion R2 includes a bearing portion and a gear mechanism for changing a rotation axis direction. The ball axis 13 is rotatably supported by a bearing portion B4 and the bearing portion in the rotation transmission portion R2.

The shaft 4 penetrates the nut member 12. The shaft 4 functions as a guide axis when a lower portion of the treatment element drive unit 3 and the nut member 12 move in the left-right direction. The opposite ends of the shaft 4 are supported by a pair of support portions S1 and S2. The guide roller 5 is rotatably fitted to the second extension portion 2A2, and the guide roller 6 is rotatably fitted to the third extension portion 2A3.

In the massage unit 1', the treatment element drive unit 3 is movable in the left-right direction with respect to the base member 2, and thus positions of the treatment elements 31 and 32 are adjustable in the left-right direction.

4. Overview

An above-described massage unit includes a base member, a treatment element drive unit having a treatment element and a drive portion which drives the treatment element, and a slide mechanism which is extensible and contractible in a slide axis direction which is along a surface that is substantially perpendicular to a left-right direction. Here, a lower portion of the treatment element drive unit is fitted to the base member to be rotatable about a first rotation axis extending along the left-right direction, one end of the slide mechanism is fitted to a lower portion of the base member, the other end of the slide mechanism is fitted to the treatment element drive unit, and, for the fitting of the one end and the other end of the slide mechanism, at least one of the following structures is adopted: a structure where the one end of the slide mechanism is fitted to the lower portion of the base member to be rotatable about a second rotation axis extending along the left-right direction; and a structure where the other end of the slide mechanism is fitted to the treatment element drive unit so as to be rotatable about a third rotation axis extending along the left-right direction (First Configuration).

The massage unit having the above-described first configuration may further include an up-and-down axis extending along the left-right direction and interlocked with an up-and-down motor which is a drive source for moving the massage unit up and down. Here, the first rotation axis is disposed closer to a body of a treated person than the up-and-down axis is (Second Configuration).

In the massage unit having the above-described first or second configuration, the slide mechanism may include a slide motor which is a drive source for the slide mechanism (Third Configuration).

In the massage unit having the above-described third configuration, the slide mechanism may include a sensor which directly detects an extension-contract amount of the slide mechanism (Fourth Configuration).

In the massage unit having the above-described first or second configuration, the slide mechanism may include a damper which generates a resistance force against contraction (Fifth Configuration).

In the massage unit having any one of the above-described first to fifth configurations, an up-and-down motor which is a drive source for moving the massage unit up and down and an up-and-down axis extending along the left-right direction and interlocked with the up-and-down motor may be disposed in an upper portion of the base member, the treatment element drive unit and the slide mechanism may be movable in the left-right direction with respect to the base member, and a left-right direction movement motor which is a drive source for moving the treatment element drive unit and the slide mechanism in the left-right direction with respect to the base member may be disposed in a lower portion of the base member (Sixth Configuration).

A massage machine disclosed herein includes the massage unit having any one of the above-described first to fifth configurations, a body support portion which supports a body of a treated person, and a guide rail which extends along a surface of the body support portion, the surface being in contact with the body, and the massage unit is guided by the guide rail to move up and down in the body support portion (Seventh Configuration).

What is claimed is:

1. A massage unit comprising:

a base member;

a treatment element drive unit which has a treatment element and a drive portion which drives the treatment element; and a slide mechanism which is extensible and contractible in a slide axis direction which is along a surface substantially perpendicular to a left-right direction, wherein a lower portion of the treatment element drive unit is fitted to the base member to be rotatable about a first rotation axis extending along the left-right direction, one end of the slide mechanism is fitted to a lower portion of the base member, an other end of the slide mechanism is fitted to the treatment element drive unit, and wherein for fitting of the one end and the other end of the slide mechanism, both of the following structures are adopted:

a structure where the one end of the slide mechanism is fitted to the lower portion of the base member to be rotatable about a second rotation axis extending along the left-right direction; and a structure where the other end of the slide mechanism is fitted to the treatment element drive unit to be rotatable about a third rotation axis extending along the left-right direction, wherein an up-and-down motor which is a drive source for moving the massage unit up and down and an up-and-down axis extending in the left-right direction and interlocked with the up-and-down motor are disposed in an upper portion of the base member, the treatment element drive unit and the slide mechanism are movable in the left-right direction with respect to the base member, and a left-right direction movement motor which is a drive source for moving the treatment element drive unit and the slide mechanism in the left-right direction with respect to the base member is disposed in a lower portion of the base member, wherein the base member includes a flat plate member and a U-shaped member, the U-shaped member includes a base portion, a left wall portion extending backward from a left end of the base portion, and a right wall portion extending backward from a right end of the base portion, and a front surface of the base portion is secured to a center of a back surface of a first extension portion of the flat plate member, wherein the one end of the slide mechanism is fitted to the left and right wall portions of the U-shaped member, to be rotatable about the second rotation axis, and the other end of the slide mechanism is fitted to the treatment element drive unit to be rotatable about the third rotation axis, the third rotation axis is disposed at a position that is behind and above the second rotation axis.

2. The massage unit according to claim 1, further comprising the up-and-down axis extending along the left-right direction and interlocked with the up-and-down motor which is the drive source for moving the massage unit up and down, wherein the first rotation axis is configured to be disposed closer to a body of a treated person than the up-and-down axis is.

3. The massage unit according to claim 2, wherein the slide mechanism includes a slide motor which is a drive source for the slide mechanism.

4. The massage unit according to claim 3, wherein the slide mechanism further includes a sensor which directly detects an extension-contraction amount of the slide mechanism.

5. The massage unit according to claim 1, wherein the slide mechanism includes a slide motor which is a drive source for the slide mechanism.

6. The massage unit according to claim 5, wherein the slide mechanism further includes a sensor which directly detects an extension-contraction amount of the slide mechanism.

7. A massage machine comprising:

the massage unit according to claim 1;

a body support portion which is configured to support a body of a treated person; and a guide rail which extends along a surface of the body support portion, the surface being configured to contact the body of the treated person, wherein the massage unit is guided by the guide rail to move up and down in the body support portion.

* * * * *